US008590358B2

(12) United States Patent
Frattini et al.

(10) Patent No.: US 8,590,358 B2
(45) Date of Patent: Nov. 26, 2013

(54) APPARATUS FOR FORMING METAL CONTAINER COMPRISING ONE OR MORE DEVICES THAT ARE ELECTRONICALLY COORDINATED TO PERFORM OPERATIONS OF LOCAL AND/OR EXTENSIVE DEFORMATION OF METAL CONTAINERS

(75) Inventors: Roberto Frattini, Ponteranica (IT); Anthony Kendrick Nixon, Otley (GB)

(73) Assignee: Frattini S.p.A. Construzioni Meccaniche, Seriate (Bergamo) (IT)

( * ) Notice: Subject to any disclaimer, the term of this patent is extended or adjusted under 35 U.S.C. 154(b) by 842 days.

(21) Appl. No.: 11/891,100

(22) Filed: Aug. 9, 2007

(65) Prior Publication Data

US 2008/0034823 A1 Feb. 14, 2008

(30) Foreign Application Priority Data

Aug. 9, 2006 (EP) ..... 06425580

(51) Int. Cl.

| | |
|---|---|
| ***B21D 51/26*** | (2006.01) |
| ***B21D 11/10*** | (2006.01) |
| ***B21D 51/28*** | (2006.01) |
| ***B21J 11/00*** | (2006.01) |
| ***B65G 43/00*** | (2006.01) |
| ***B65G 43/08*** | (2006.01) |
| ***B65G 43/10*** | (2006.01) |
| ***B65G 37/00*** | (2006.01) |

(52) U.S. Cl.

USPC ..... 72/379.4; 72/94; 72/405.03; 413/69; 198/571; 198/572; 198/573; 198/574; 198/575; 198/576; 198/577

(58) Field of Classification Search

USPC ..... 72/94, 379.4, 405.03; 413/69; 198/571–577

See application file for complete search history.

(56) References Cited

U.S. PATENT DOCUMENTS

| | | | | |
|---|---|---|---|---|
| 2,550,156 | A | 4/1951 | Lyon | |
| 3,913,366 | A | 10/1975 | Nelsen et al. | |
| 4,513,595 | A | 4/1985 | Cvacho | |
| 4,519,232 | A | 5/1985 | Traczyk et al. | |
| 5,557,959 | A * | 9/1996 | Wallis et al. | 72/20.2 |
| 5,768,931 | A * | 6/1998 | Gombas | 72/184 |
| 6,178,797 | B1 | 1/2001 | Marshall | |
| 7,035,714 | B2 * | 4/2006 | Anderson et al. | 700/228 |
| 2005/0016235 | A1 * | 1/2005 | Zusi | 72/15.1 |
| 2005/0193796 | A1 * | 9/2005 | Heiberger et al. | 72/356 |

FOREIGN PATENT DOCUMENTS

| | | |
|---|---|---|
| EP | 0767713 | 5/2005 |

OTHER PUBLICATIONS

European Search Report.

* cited by examiner

*Primary Examiner* — Dana Ross
*Assistant Examiner* — Justin V Lewis
(74) *Attorney, Agent, or Firm* — Bucknam and Archer

(57) ABSTRACT

An apparatus (10) for forming a metal container including one or more devices that are electronically coordinated to perform operations of local and/or extensive deformation over metal containers and one or more interface devices (12) wherein the motion among the devices is accomplished in an indirect way through elements adapted to coordinate and synchronize these same devices.

11 Claims, 2 Drawing Sheets

APPARATUS FOR FORMING METAL CONTAINER COMPRISING ONE OR MORE DEVICES THAT ARE ELECTRONICALLY COORDINATED TO PERFORM OPERATIONS OF LOCAL AND/OR EXTENSIVE DEFORMATION OF METAL CONTAINERS

This invention refers to an apparatus for forming metal containers, comprising one or more devices that are electronically coordinated to perform operations of local and/or extensive deformation of metal containers.

More specifically, this invention refers to an apparatus as specified above, particularly suitable for performing multiple sequential operations, even in continuous mode, over the side surface of metal containers made from aluminium, its alloys, steel or other suitable materials. Such containers, made as metal, rough, extruded, spun or deep-drawn pieces, originally have a cylindrical shape which is worked or shaped afterwards.

These containers, before the sequences of operations that deform and/or taper the side surface, in part or as a whole, can be coated inside and/or outside and lithographed along the outer side surface; this latter operation is meant to perform inscriptions or decorations in various colours, along with indications about the contents and information on the metal containers for the ultimate consumer.

The apparatus of this invention performs the processing of metal containers such as, for instance, aerosol, beverage bottles, drink cans and similar items, at the final stages of the process, namely when the cylindrically-shaped metal container, still open at one end, undergoes plastic deformation processes meant to change its structure in a partial manner, e.g. processes called "necking" or "tapering", or in a global manner, namely "shaping" processes. On these metal containers, the apparatus of this invention also carries out embossing/debossing cycles, which create, on given areas of the side surface, moulded features and other patterns of various shape defined by hollow and/or embossed sectors.

Containers used for beverages, food or aerosol show differences among themselves based on the complexity of manufacture limiting the number of the elementary operations required. The different types of production, in connection with the various types of metal containers, can be graded based on the following parameters:

High or low production speed;

High or low production complexity.

Containers used for beverages, such as for instance those in the shape of a can or "pop can" are characterized in that they have a limited productive complexity and the operations required to obtain the finished item, starting from the metal rough piece, do not generally demand more than fifteen working stations; for this type of containers, production rate is generally quite high (3000 cpm—cans per minute) and can be reached by using non-stop processing machines.

Aerosol containers, generally demanding a more complex manufacture, need a larger number of operations which, as of today, are carried out by using so-called index-motion reciprocating table machines which are able to cover the low production rates (200 cpm—cans per minute approx.) currently demanded by the market for that segment.

At present, however, on the market there has been a big increase in the need to manufacture, at high speed, especially for the beverage segment, containers featuring complex shapes for example so-called "bottle cans" and/or "contour cans", which include shape and/or deformations that extend almost all over the side surface and which duplicate the aesthetic characteristics of glass or PET containers. The manufacture of this type of metal container may currently demand up to sixty processing steps. Moreover, the need for a high production speed imposes the use of continuous cycles machine.

The known art to manufacture, in continuous cycles, containers for the beverage market segment of the "pop can" type, envisages the use of in-line systems, often of modular type such as those described in the patents mentioned below.

Patent EP 0 767 713 (Marrit et Al.) deals with a modular system composed of a plurality of prefabricated modules, connected side by side, and which define the support rotating turret assemblies equipped with a plurality of the same or different shaping tools. These turret assemblies are basically located next to one another, so that the metal containers that have been processed by the tools of one of these turret assembly are moved directly to another turret assembly. Furthermore, the side-by-side connection of the modules defines a direct interconnection to carry the cans from one processing station to the next by motion transmission among individual modules.

U.S. Pat. No. 4,513,595 (Cvacho) refers to a method and apparatus for necking and flanging a tubular metal can body. The apparatus includes a plurality of work stations, which are connected together to move the metal containers from one work position to another.

U.S. Pat. No. 2,550,156 (Lyon) describes an apparatus for moving and and processing metal containers wherein the operations are carried out on a modular structure, made up of a set of "boxes" connected to side rails and to a baseplate. The power drive is transmitted by means of a main drive shaft that extends longitudinally beneath the frame units. Moreover, the number of units relies on the length of the main shaft as well as on that of the baseplate.

U.S. Pat. No. 4,519,232 (Traczyk et Al.) describes a modular system to shape metal containers, made up of a plurality of substantially identical modules comprising revolving turrets equipped with a plurality of processing tools all along their perimeter.

However, all of these devices or systems present a remarkable problem, namely that in a modular structure, motion transmission drive from one unit to the other occurs in a direct manner, e.g. by using gearing-chains, which in some embodiments prove to be particularly critical because, to ensure synchronization of the several units or modules—synchronization being essential to obtain a high-quality finished product—the use of additional parts that suit the purpose is needed; such parts are often extremely sophisticated from the mechanical viewpoint, and their accuracy depends on the number of units or modules envisaged for the processing stages.

A further problem is that the direct type of motion transmission drive among the modules is generally combined with the use of only one motor, shared by the entire machine or device, which requires the mechanical parts of each module to be oversized, since each module must be able to support the power transmission of the entire machine. This also causes the costs of storage and spare parts to increase.

A further problem is that these devices or systems, in the event of an emergency stop, basically demand a long time lag, generally ranging between 10 and 15 seconds in order to brake or stop in an emergency and without damaging the mechanically moving parts.

The object of this invention is to remedy the foregoing problems.

More specifically, the object of this invention is to provide an apparatus for forming metal containers comprising one or more devices that are electronically coordinated to perform operations of local and/or extensive deformation over metal containers, featuring great flexibility, modularity and which may be used for different processing cycles on metal containers meant to serve both the beverage and the aerosol market segments and, furthermore, which is such as to allow for transfer and handling of metal containers from one work station to the next in an easy, simple manner, regardless of the complexity of the system.

A further object of this invention is the provision of an apparatus as described above, that is adapted to make up a structure of moderate size regardless of the complexity and the number of processing cycles to be executed on the metal container, and such as not to require excessive space for installation.

A further object of this invention is to provide the users of a device that is suitable for ensure a high level of strength and reliability over time, and also such as to be easily and cheaply manufactured.

These objects as well as others are accomplished by an apparatus for forming metal container comprising one or more devices that are electronically coordinated to perform operations of local and/or extensive deformation over metal containers of this invention, which includes one or more interface devices wherein the motion among the devices is accomplished in an indirect way through means adapted to coordinate and synchronize these same devices.

The structural and functional characteristics of the apparatus for forming metal container comprising one or more devices that are electronically coordinated to perform operations of local and/or extensive deformation over metal containers of this invention can be better understood from the detailed description that follows, wherein reference is made to the attached drawings that illustrate a preferred embodiment, which is not meant to be restrictive in character, and wherein.

Figure 1:
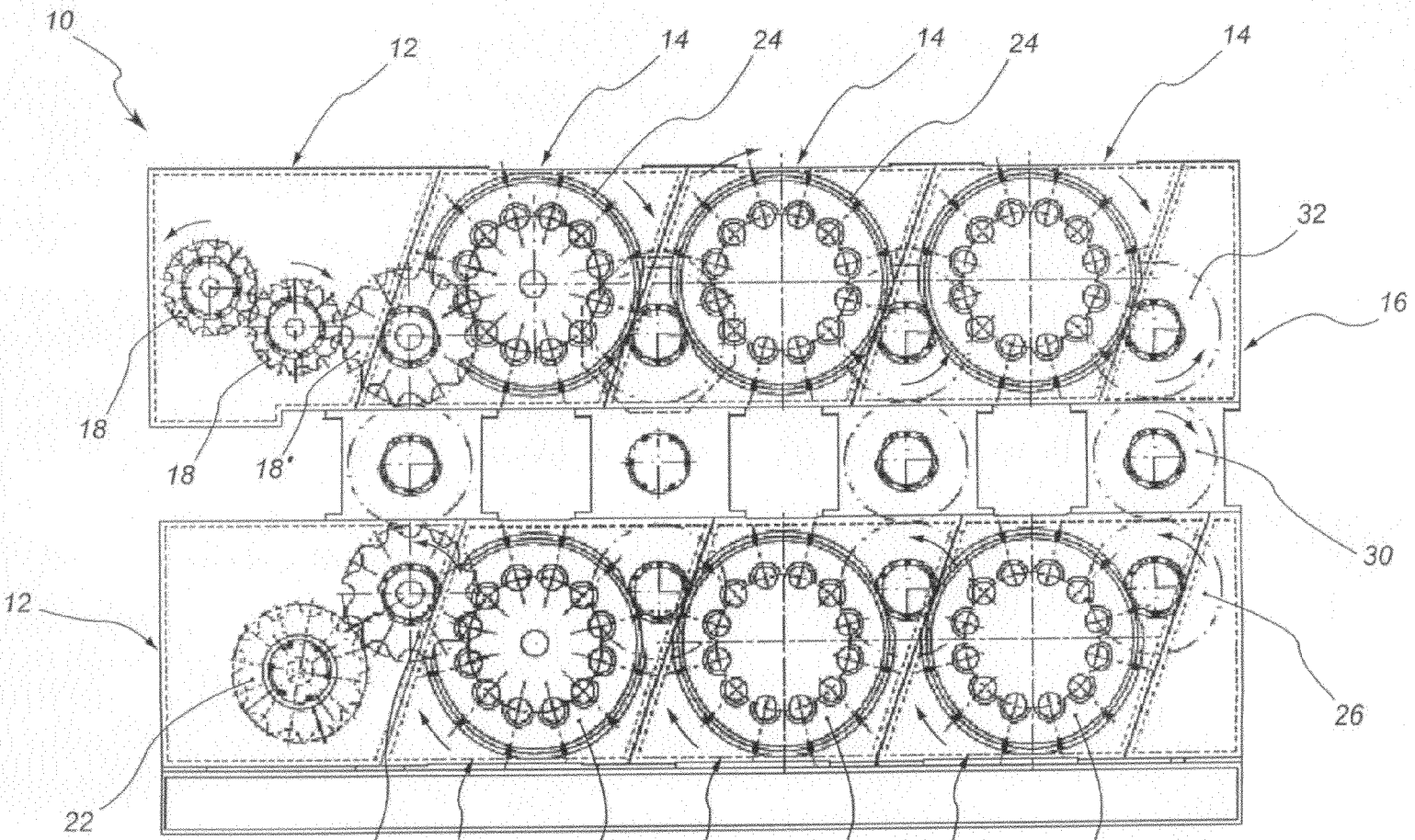
FIG. 1 is a structural diagram of the apparatus for forming metal container comprising one or more devices that are electronically coordinated to perform operations of local and/or extensive deformation over metal containers of this invention.

With reference to the above-mentioned figures, the apparatus for forming metal container comprises one or more devices that are electronically coordinated to perform operations of local and/or extensive deformation over metal containers of this invention, referenced with number 10 in FIG. 1, and includes one or more interface devices 12, one or more working devices 14, basically equal to one another, and, optionally, a reversal device 16; all of said devices are arranged in such a way as to form different types of route, generally of closed-loop type.

The interface device 12, which in the preferred embodiment depicted in FIG. 1 includes an upper portion and a lower one, is made up of one or more loading drums 18 and 18', and one or more unloading drums 22 and 22'.

Each working device 14, as schematically illustrated in FIG. 1, is composed of an upper portion and a lower portion, each one of these including at least one turret 24 and at least one transfer drum 26. Each turret 24, which is preferably circular, comprises along its own circumference, a plurality of moulds or chucks, all equal to or different from one another, adapted to execute the forming operations on the side surface of the metal containers.

The optional reversal device 16, if provided, includes a further change drum 30 and a further transfer drum 32. These further transfer drums 32 are functionally linked with the further change drum 30. The purpose of such optional reversal device 16 will be described in detail below.

Each of the foregoing drums and turrets is composed of a plate or disc, on which bays for a preset number of containers are made and which can turn around the axis of the plate. Such rotation allows the metal containers to move within the device. These metal containers are only allowed to perform a relative movement as to the plate during the loading and the unloading.

According to a preferred embodiment, shown in FIG. 1, the turrets 24, the transfer drum 26 and the further transfer drum 30, the feeding 18, 18' and the unloading 22, 22' drums are placed with their axes of rotation parallel to one another, so that the motion of the metal containers occurs on a single plane that is perpendicular to the very same axes. Furthermore, the mentioned elements are all provided with a synchronous rotatory motion occurring as specified hereinafter.

The plurality of drums 18, 18', 22, 22', 26, 30 and 32, as well as the turrets 24 are arranged according to a generally closed-loop route. Moreover, each of the turrets 24 includes a revolving table equipped with gripping members or nippers (not shown in the figure) and a further revolving table equipped with processing tools or moulds (not shown in the figure).

The tools to deform or shape the metal containers are fixed to the revolving table, whereas the gripping members or nippers, fastened to a second revolving table that is co-axial to the tools-bearing table, may shift in a direction that is parallel to the axis of rotation of the tables. However, in an alternative embodiment, the tools-bearing table only, or both tables can be allowed to move.

While the apparatus of the invention is operating, most of the gripping members or nippers holds and supports a metal container being processed; this is meant to accomplish the simultaneous processing of several metal containers on each turret 24.

The change drums 30 perform the dual function of closing the route of the metal containers being processed and helping correctly to position them on the turrets 24.

Moreover, according to the invention, each metal container can be made to circulate one or several times on the turrets 24 that are equipped with equal or different tools or moulds by means of the optional reversal device 16.

It is however understood that the change drum 30, which in the preferred embodiment shown in FIG. 1 is placed within the optional reversal device 16, can be located within any of the working devices 14. Thus modified, the working devices 14 prove to be functionally similar to the optional reversal device 16 and therefore allow the working devices 14 coming next to be cut out, thus allowing the processing cycles on the metal containers to be choked, following specific needs.

The devices (the interface devices 12, the working devices 14 and the optional reversal device 16) making up the apparatus of this invention could also be made and defined as independent units or modules joined or assembled together and are, as far as motion transmission is concerned, mechanically independent and motion coordination occurs as described hereinafter.

The optional reversal device 16 which, as already said with reference to the preferred embodiment, can be arranged as a closing device or used to choke operation of the apparatus of this invention, is not independent as far as motion is concerned, whereas it receives, in a known manner, the power from the adjacent devices.

In a preferred embodiment, the optional reversal device 16 features independent motion.

Figure 2:
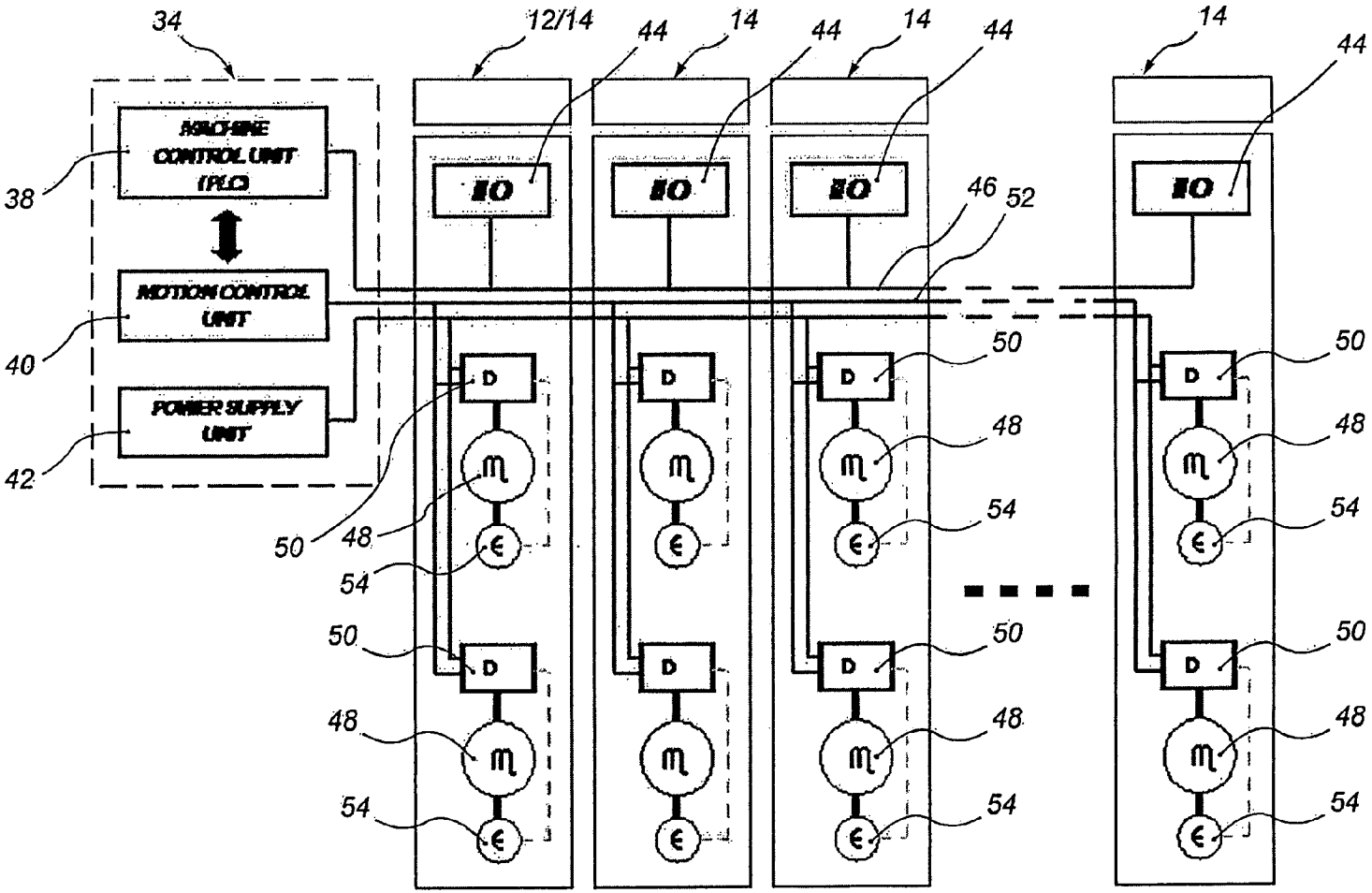
FIG. 2 is a functional diagram of the apparatus of this invention.

Indeed, with special reference to FIG. 2, the apparatus 10 of the invention includes a control system 34 which can control and coordinate the motion of each device 12 and 14 as described above. The control system 34 includes:

- A device control unit or assembly 38 comprising, for instance, an ordinary PLC (Programmable Logic Controller) and adapted to coordinate the operating logic of the interface devices 12, the working devices 14 and of the optional reversal device 16;
- A motion control unit or assembly 40 which is able to ensure motion synchronization of the drums and turrets provided with each of said devices;
- A power supply unit or assembly 42 that is adapted to distribute electric power to the same devices considered above.

The control system 34 operates according to a known centralized control system configuration, which means that there is a single control system which is shared by all of the devices of the apparatus described in this disclosure, and the device control unit 38 performs a continuous data exchange with the motion control unit 40. More specifically, all of the data coming from the moving members of the interface device 12, the working devices 14 and the optional reversal device 16, are received by the above-defined motion control unit 40, possibly re-processed by the device control unit 38 and then used by the motion control unit 40 to accomplish motion synchronization among all of the devices.

In an alternative embodiment, each of the devices (the interface device 12, the working device 14 and the optional reversal device 16) making up the apparatus of the invention comprises its own control system, according to a distributed control system configuration; the devices mentioned above communicate with one another and coordinate between one another by using data communication and transfer technologies of known type.

In a further alternative embodiment, the control and coordination system of said devices that make up the apparatus described in this disclosure is made by adopting a hybrid control system configuration wherein the control system is partly centralized and partly distributed over said individual devices.

Each interface device 12, working device 14 and optional reversal device 16, which makes up the apparatus of this invention includes:

- at least one input/output or "I/O" component 44, that transmits to the device control unit 38 the signals coming from the sensors located on each of said devices and receives from the same device control unit the required command signals for each device to operate; the data exchange occurs e.g. by means of a control bus 46 or another suitable data transfer means;
- one or more motors 48, e.g. of the "direct drive" type, that is with direct coupling without using gearmotors, or of another known type, defining the movement of the rotational mechanical elements of each interface device 12, working device 14 and optional reversal device 16, of the apparatus of this invention and/or of parts of said devices like the tools;
- one or more drivers 50 of known type, in the same number as the number of the motors 48, connected to the latter and adapted to control and manage operation through the parameters and data transmitted to and received from the motion control unit 40; communication between these drives 50 and the motion control unit 40 being accomplished e.g. via a further control bus 52 or an equivalent data transmission means;
- one or more angular measuring means, defined for instance by an encoder 54 of absolute type and adapted to adjust speed and/or the positions of the motors 48. The use of absolute type encoders makes it possible not to lose the position references in cases when the moving members of the interface devices 12, working devices 14 and reversal device 16, if provided, stop due to maintenance or tooling changes or due to an emergency/alarm.

The encoders 54 are individually connected to the motors 48 and electrically wired to the drives 50.

The device control unit 38 of the control system 34, by interacting with the motion control unit 40, analyzes the operating logic of the devices that make up the apparatus of this invention, namely the interface devices 12, the working devices 14 and the optional reversal device 16, and ensure motion synchronization of the revolving members of one device as to the previous one and/or the subsequent one. The revolving members of each device 12, 14 and 16 are, as already implied, the turrets 24 and the several feeding, change, unloading, transfer drums and/or the tools.

Motion synchronization and the coordination of said devices among themselves occurs by means of a control technology defined as "master-slave" according to which a specific device behaves as a physical "master" or main device and makes its own revolving members or "axes" move in compliance with a preset motion law. The "slave" or secondary/subordinate device follows the motion of the "master" device with angular position and speed synchronization. All of the "slave" devices must follow, within a given tolerance range, the reference provided by the "master" device and, in cases when the individual "slave" devices are not in a position to comply with such tolerance range, through the additional control bus 52, they send an alarm signal to the motion control unit 40 which, by interacting with the device control unit 38, adjusts the motion in order to recover synchronization, or stops or reduces the speed of the device(s).

In an alternative embodiment, the synchronization among the reference devices 12, working devices 14 and optional reversal device 16 making up the apparatus of this invention can be accomplished by using a "virtual master axis", that is there is no physical "master" device, but the main revolving member or "axis" is simulated via a software application that generates position and speed signals followed by the "slave" devices with angular position and speed synchronization.

In a further alternative embodiment, the synchronization among the devices above considered and making up the apparatus of this invention can be accomplished by means of a control technology known as "cascade slave", wherein a "master axis" or main "axis" generates a first position and/or speed reference value that is transmitted to a first "slave" device which, in turn, sends the position and/or speed reference value to the "slave" device coming next, and so on until the last "slave" device is reached.

In cases when emergency situations or failures occur, the control system 34 stops all of the moving members of the interface devices 12, working device 14 and optional reversal device 16 almost immediately or however in a shorter time compared to the stop delays demanded by a mechanical system whose motion transmission drive members are connected in a direct manner; the foregoing stop of the moving members, namely the turrets 24 and the transfer drums 26, occurs by ensuring the mutual synchronization among these moving members and, hence, among the individual devices, so as to avoid all jamming and damages to the metal containers thus moved.

The foregoing disclosure described the obvious advantages brought by this invention.

The apparatus for forming metal container comprising one or more devices that are electronically coordinated to perform operations of local and/or extensive deformation over metal containers of this invention advantageously allows the set up of a system featuring high adjustability and flexibility, so as to quickly meet the various and multiple market demands owing to a modular structure made up of independent and electronically coordinated devices.

Further advantageous is the fact that this apparatus makes it possible to choke the productive cycle, for example to perform maintenance services, by cutting out some devices through the change of the individual devices enforced, for instance, through the insertion or the movement of the additional change drum 30 of the optional reversal device 16.

A further advantage is that, since each device is thoroughly independent from the others, they become separate machines whose number can be quickly and easily modified as a function of the productive characteristics and/or the number of steps required to process the metal containers; this also allows a greater extensibility of the system than that which can be achieved with a traditional mechanical structure to be provided.

A further advantage is that, in cases when an emergency stop is needed, the apparatus of this invention, made up of an assembly of independent devices, allows the emergency stop of each device to be independently managed and the stopping time to be brought to about 2 or 3 seconds, regardless of the number of devices.

Further advantageous is that the devices of the apparatus of this invention, which are independent from one another as regards motion transmission drive, have a simple mechanical configuration, feature low costs and facilitate maintenance operations; in the event of an electrical or mechanical fault, the operator in charge of the repair operates on the individual device, so as to allow production to be quickly resumed.

A further advantage of the apparatus of this invention is that, since the control system 34 receives from the devices information concerning, for instance, the electrical inputs of the motors, it also runs mechanical diagnostic functions on the same devices.

Although the foregoing description has specifically considered a preferred embodiment of the apparatus of the invention, which is only illustrative and not restrictive in character, several modifications and variations will be obvious to any person of ordinary skills in the art in the light of the foregoing description. Therefore, this invention is meant to include all modifications and variations that fall within the scope of the attached claims.

The invention claimed is:

1. An apparatus (10) of modular construction for forming metal containers wherein a closed-loop route for said containers is formed along which operations of local and/or extensive deformation are performed over said containers, said apparatus comprising:

a) a plurality of working devices (14) each in the form of a modular unit adapted to be operatively connected in sequence, each working device (14) including an upper portion and a lower portion wherein each portion includes a turret (24) having forming devices adapted to work said containers and a transfer drum (26) adapted for transferring worked containers to a successive working device (14);

b) an interface device (12) in the form of a modular unit including a container loading station adapted to be operatively connected to a turret of an upper portion of a first working device (14) of said sequentially connected plurality of working devices and a container unloading station adapted to be operatively connected to a turret of a lower portion of said first working device (14) of said sequentially connected plurality of working devices; and c) a change drum (30) associated with each working device of the plurality of working devices (14), each change drum being disposed between the transfer drum (26) of the associated working device transferring the worked containers from the associated working device upper portion and the transfer drum (26) transferring containers to the associated working device lower portion, wherein each of said change drums is adapted to be selectively operatively connected to the transfer drums of the upper and lower portions of the working device associated with the selected change drum whereby the closed-loop route of said containers can be interrupted at said working device so that the working devices sequentially arranged downstream are bypassed.

2. The apparatus (10) according to claim 1, further comprising an optional reversal device (16) in the form of a modular unit adapted to be operatively connected to a last working device (14) of said sequentially connected plurality of working devices in place of the change drum (30) associated with said last working device (14) so as to reverse the direction of said containers along said closed-loop route, said reversal device (16) including a change drum (30) adapted to transfer containers from the upper portion of said last working device (14) to the lower portion of said last working device (14).

3. The apparatus (10) according to claim 2, wherein motion synchronization and the coordination among the interface device (12), the working devices (14) and the optional reversal device (16) occur by using a "master-slave" control technology with a "master" device of physical type.

4. The apparatus (10) according to claim 2, wherein motion synchronization and the coordination among said interface, working and optional reversal devices (12, 14, 16) occurs by using a "virtual master axis" control technology.

5. The apparatus (10) according to claim 2, wherein the motion synchronization among said interface, working and optional reversal devices (12, 14, 16) occurs by using a control technology with a "cascade slave" control technology.

6. The apparatus (10) according claim 1, wherein said interface device (12) includes one or more loading drums (18, 18') and one or more unloading drums (22, 22').

7. The apparatus (10) according to claim 2, wherein said optional reversal device (16) includes a transfer drum (32).

8. The apparatus (10) according to claim 2, which further comprises a control system (34) for coordinating and electronically synchronizing said interface device (12), said plurality of working devices (14), and said optional reversal device (16) according to a centralized control system configuration, said controls system (34) including:

a device control unit (38) adapted to coordinate the operating logic of the interface device (12), the plurality of working devices (14), and the optional reversal device (16);

a motion control unit (40) adapted to maintain motion synchronization among said interface, working, and optional reversal devices; and a power supply unit (42) adapted to distribute electric power to the elements of apparatus (10).

9. The apparatus (10) according to claim 2, which further comprises a control system for each of said interface, working, and optional reversal devices according to a distributed control system configuration wherein the interface, working, and optional reversal devices communicate with one another and coordinate between one another using data communications and transfer technologies.

10. The apparatus (10) according to claim 2, which further comprises a control system for said interface, working and optional reversal devices according to a hybrid control system configuration wherein the control system is partly centralized and partly distributed over said devices.

11. The apparatus (10) according to claim 8, wherein each of said interface working, and optional reversal devices includes:

an input/output ("I/O") component (44), which transmits to said device control unit (38) signals coming from sensors located on said interface, working and optional reversal devices and receives from the device control unit (38) command signals for operating each of said devices;

a motor (48);

a drive (50) connected to said motor (48) and adapted to control and manage said motor's operation through the parameters and data sent to and received from the motion control unit (40); and an encoder (54) of absolute type adapted to adjust the speed and position of said motor (48).

* * * * *